US006821080B2

(12) United States Patent
Müller

(10) Patent No.: US 6,821,080 B2
(45) Date of Patent: Nov. 23, 2004

(54) METHOD AND DEVICE FOR STACKING FLAT OBJECTS

(75) Inventor: Erwin Müller, Dürnten (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/333,562

(22) PCT Filed: Jul. 13, 2001

(86) PCT No.: PCT/CH01/00439

§ 371 (c)(1),
(2), (4) Date: Jan. 23, 2003

(87) PCT Pub. No.: WO02/08101

PCT Pub. Date: Jan. 31, 2002

(65) Prior Publication Data

US 2003/0170110 A1 Sep. 11, 2003

(30) Foreign Application Priority Data

Jul. 24, 2000 (CH) ..... 1451/00

(51) Int. Cl.[7] ..... B65H 29/02
(52) U.S. Cl. ..... 414/788.3
(58) Field of Search ..... 414/788.3, 791.2, 414/791.3; 271/65, 186, 204, 213, 218, 298, 300

(56) References Cited

U.S. PATENT DOCUMENTS

| | | | | |
|---|---|---|---|---|
| 3,477,591 A | * | 11/1969 | Andersson | 414/788.3 |
| 3,974,921 A | | 8/1976 | Tokuno | |
| 4,214,743 A | * | 7/1980 | Meier | 271/182 |
| 4,445,681 A | | 5/1984 | Reist | |
| 4,666,143 A | * | 5/1987 | Reist | 274/204 |
| 4,886,265 A | | 12/1989 | Wetter | |
| 5,110,116 A | * | 5/1992 | Kobler et al. | 271/277 |
| 5,746,425 A | | 5/1998 | Flannery, Jr. | |
| 6,270,076 B1 | * | 8/2001 | Reist | 271/302 |
| 6,325,592 B1 | * | 12/2001 | Meier | 414/790.5 |
| 6,357,574 B1 | | 3/2002 | Eberle et al. | |
| 6,612,563 B1 | * | 9/2003 | Noll, Jr. | 271/69 |
| 6,619,651 B2 | * | 9/2003 | Mader | 271/82 |
| 6,669,192 B2 | * | 12/2003 | Reist | 271/225 |

FOREIGN PATENT DOCUMENTS

| | | |
|---|---|---|
| CA | 2232804 | 3/1998 |
| DE | 27 52 513 A1 | 4/1979 |
| EP | 0 870 710 A1 | 10/1998 |

* cited by examiner

*Primary Examiner*—Douglas Hess
(74) *Attorney, Agent, or Firm*—Rankin, Hill, Porter & Clark LLP

(57) ABSTRACT

For producing stacks (20), flat objects (2) are supplied individually held by holding elements (3) in an edge zone (10). Groups (1) of the objects (2) are supplied one behind the other and arranged in a stack by placing object zones opposite the held edges (10) adjacent to one another. While the objects (2) are held, the groups arranged in a stack are stabilized by positioning the object zones opposite the held edges (10) on a stacking table (23) that is vertically movable inside a stacking shaft (22) and/or on an auxiliary support (31), and are either strapped or pressed together by a pressing device. Prior to being deposited on a stacking table (23), groups (1) formed one behind the other and arranged in a stack may be rotated around the stacking axis (A), so that they are positioned in the stacking shaft (22) as layers of a cross stack.

17 Claims, 6 Drawing Sheets

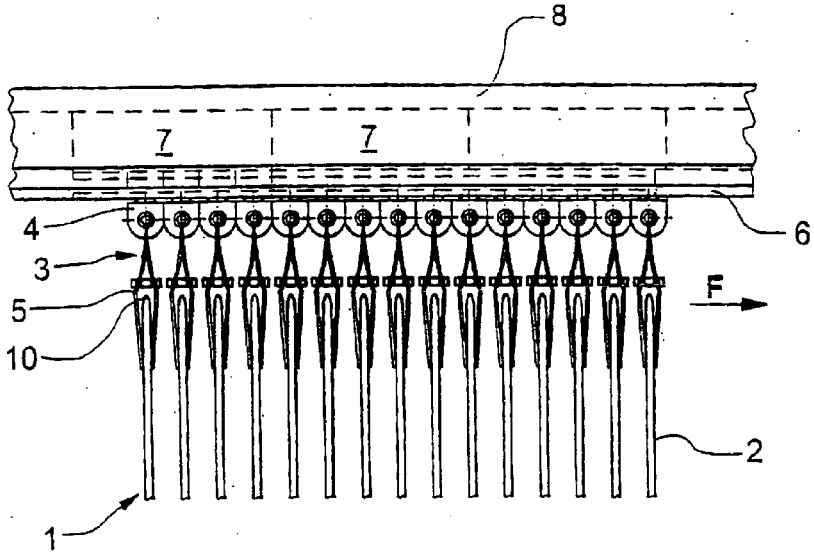
Fig.1
Fig.2a
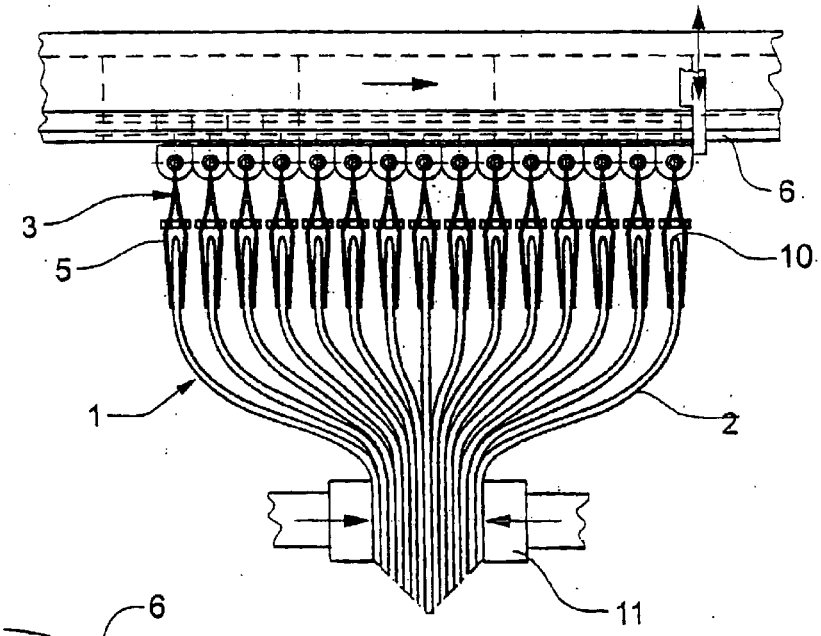
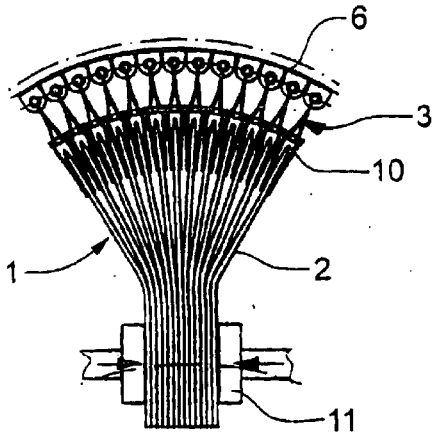
Fig.2b

6
A
3
10
6.3
1
2
31
22
6.5
6.4
23

6
A
3
10
1
2
31
6.5
6.4
23
22
20
40

METHOD AND DEVICE FOR STACKING FLAT OBJECTS

BACKGROUND OF THE INVENTION

1. Field of the Invention

The present invention is related to the field of materials handling technology and concerns a method and a device for stacking flat objects, in particular printed products such as newspapers, periodicals, etc., that are supplied to be stacked serially in a supply stream.

2. Description of Related Art

Printed products are stacked, for example, for intermediate storage between processing steps or for packaging prior to being dispatched. Serving for the stacking, for example, is a stacking shaft with a substantially vertical stacking axis, which stacking shaft has a ground plan essentially corresponding to the shape of the objects to be stacked and comprises at its bottom an advantageously vertically displaceable stacking table. On its upper end (opposite the stacking table) the stacking shaft is open. The products are transported to this upper shaft end and are positioned in the stacking shaft through its opening.

Printed products are transported to a stacking shaft of the above described kind arranged in an imbricated stream loosely lying on a conveying surface, for example, on a conveyor belt, wherein the leading product edges are situated on the top side of the stream. The products are conveyed in the named manner to the opening of the stacking shaft, and every product is pushed over this opening until it drops into the shaft or onto products already stacked in the shaft, respectively. In order to reduce the uncontrolled fall to a minimum, the stacking table, as already mentioned, is usually displaceable in a vertical direction and is adjusted such that the upper side of the stack being produced in the shaft is located immediately below the shaft opening at all points in time. This, however, signifies that every product when pushed over the stacking shaft opening, slides over the stacking table or over the top one of the products stacked in the stacking shaft. This sliding movement, particularly for not very rigid products, constitutes a movement that may not be fully controllable and, for this reason, may give rise to problems.

Stacking methods using a stacking shaft being supplied by an imbricated stream of loosely lying objects are described, for example, in the publications DE-2752513 (or CA-1091707) or EP-0309745 (or U.S. Pat. No. 4,886,265).

For stacking flat products with little rigidity it is also proposed to supply the products to the stacking shaft by means of grippers coupled to a traction organ, each one of the grippers holding one product by its leading edge and pulling it over the stacking shaft opening and then releasing it. Depending on the position of the upper side of the stack in the stacking shaft, a product being released by the gripper will drop into the shaft or, being pulled by the gripper, it will slide across the upper surface of the stack. Stacking methods of this type are described, for example, in the publications EP-0059746 (or U.S. Pat. No. 4,666,143) or DE-3130945 (or U.S. Pat. No. 4,445,681).

Both stacking methods briefly described above include horizontal supply of the products and free fall into the stacking shaft, i.e. a change of supply direction that is difficult to control and a free fall that can hardly be controlled. Even if the free fall is reduced to a minimum, the horizontal feeding-in still has to be sharply braked and the product has to be slid onto the stack surface (being pushed or pulled), which is not desirable, particularly for thin and not very rigid products.

SUMMARY OF THE INVENTION

The invention sets itself the objective of creating a method and a device for stacking flat objects being supplied serially in a supply stream, in particular printed products, without free fall and without sliding movement or at least with significantly reduced sliding movement such that stacking such objects, which are known as being difficult to stack, becomes easy. The method and device are to be easily utilized not solely for producing simple stacks, but also for producing so-called cross stacks, in which groups of superimposed products are rotated relative to one another by 180° around the stacking axis.

The main steps of the method according to the invention are the following: supplying the objects to the stacking system each held gripped individually, forming of each supplied group of still individually held objects a stack-like arrangement, stabilizing the stack-like arrangement and only then releasing the objects from being individually held and thereby forming the desired stack.

The objects are supplied individually held gripped in the zone of one of their edges, and in groups, wherein every group comprises a plurality of objects being oriented in parallel to one another, substantially transverse to the conveying direction, aligned with one another, and with such a small spacing between one another that they can be arranged stack-like while each one of the objects is still held gripped. The objects of each group forming a stack-like arrangement are then stabilized.

In the named stack-like arrangement zones opposite the held edges of the objects of the group are positioned relative to one another in substantially the same way as in a real stack, this means they are directly adjacent to one another and aligned with one another to the greatest possible degree, while the zones of the held edges are aligned with one another but spaced from one another due to the means holding them gripped.

This stack-like arrangement is stabilized in a suitable manner and only then the objects are released from being held gripped, so that the zones of the originally held gripped edges come to lie adjacent to one another and the group of objects forms a real stack, in which the objects are superimposed or juxtaposed and aligned with one another. Conveying away the stacks is realized in any known manner.

Establishing the stack-like arrangement constituting an intermediate phase of the method according to the invention is only possible if the flat objects are bendable at least to a limited extent at least parallel to their held edge and if the distances between the objects defined by their held conveyance is matched to this ability to bend and to the number of objects to be processed within one group. Completely rigid objects can theoretically only be arranged in a stack-like arrangement, as described above, if their held gripped edges are adjacent to one another without any spacing in between. A corresponding held conveyance, however, is rather difficult to realize.

The degree to which the object zones opposite the held edges are able to be aligned with one another in the stack-like arrangement is also dependent on the spacing between the held edges and on the manner in which the held edges are aligned with one another. In an arrangement in which the held edges of a group form a curved line, in particular a circular arc, there is a higher degree of alignment of the object zones opposite the held edges than in a straight-line arrangement of the held edges.

For producing cross stacks of objects which are supplied all having the same orientation, e.g. every second stack-like arrangement of a group of objects is rotated, wherein rotated and not rotated groups are stacked upon one another as crossed layers of the cross stack.

BRIEF DESCRIPTION OF THE DRAWINGS

The method in accordance with the invention and exemplary embodiments of the device according to the invention are described in detail in connection with the following Figs., wherein:

FIG. 1 shows a group of objects being conveyed in a held manner to be stacked in accordance with the invention;

FIGS. 2*a* and 2*b* show two exemplary, stack-like arrangements being produced in an intermediate phase of the method according to the invention;

DETAILED DESCRIPTION OF THE PREFERRED EMBODIMENTS

Figure 3A:
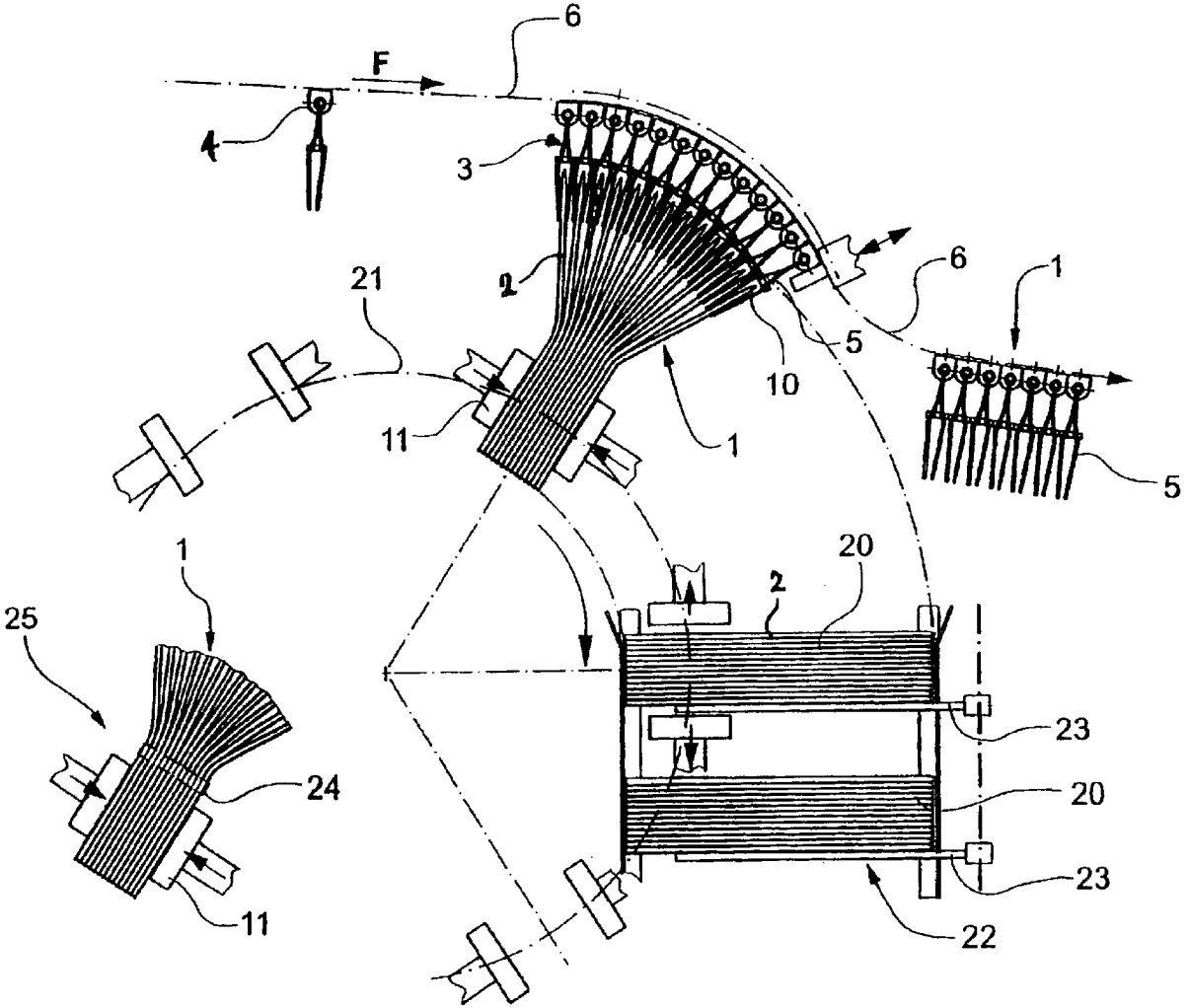
FIGS. 3*a* and 3*b* show in a schematic representation an exemplary embodiment of the method in accordance with the invention for producing simple stacks (FIG. 3*a*) and for the producing cross stacks (FIG. 3*b*)

FIG. 1 illustrates a group 1 of flat objects 2 being supplied to be stacked in accordance with the invention. The objects 2 are held gripped individually by holding elements 3. The holding elements comprise a rolling or sliding body 4 and a gripper 5 arranged on it. The objects 2 are held gripped by the gripper 5 in the zone of their upper edge 10 such that they are oriented substantially transverse to the conveying direction F, essentially parallel to one another, and aligned with one another. The rolling or sliding bodies 4 roll along a stretch of rail 6 and are driven by a suitable drive. The holding elements 3 are designed such that, when positioned on the stretch of rail 6 in contact with one another, there is a uniform distance between objects 2 held gripped. Advantageously, it is the rolling or sliding bodies 4 that define this distance by having all the same length in the conveying direction F, which length is greater than the corresponding dimensions of the grippers 5 and of the objects 2 (thickness of the objects).

The holding elements 3 advantageously are movable along the stretch of rail 6 independently of one another at least to a limited extent, i.e. with varying distances. For the stacking operation, they are driven such that the distances within groups 1 correspond to the minimum distance. A suitable drive is, for example, a drive system with magnetizable drive elements 7 being moved continuously in conveying direction along a rail 8, which is parallel to the stretch of rail 6 of the rolling or sliding bodies 4, and to which the rolling or sliding bodies 4 are coupled, as long as the drive elements 7 are magnetized.

A conveying system with holding elements 3 suitable for supplying objects 2 to be stacked in accordance with the invention, and comprising a drive to which the holding elements 3 are selectively coupled and conveyed in conveying direction F along a stretch of rail 6, is described, for example, in the publication WO-99/33731.

FIGS. 2*a* and 2*b* each illustrate a stack-like arrangement of a group 1 of objects 2 held gripped individually by holding elements 3, as established according to the invention prior to the release of the objects 2 from being held gripped. In the stack-like arrangement, object zones opposite the held edges 10 are lying against each other and are, as far as possible, aligned with one another. For stabilizing the stack-like arrangement, the object zones opposite the individually held edges 10 are held together by being pressing together by suitable pressing means 11.

FIG. 2*a*, which illustrates a straight-line alignment of the held edges 10 (straight-line stretch of rail 6 on which the holding elements 3 are lined up) clearly shows that, for establishing the stack-like arrangement, the objects 2 have to be bendable at least to a limited extent and that the minimum distance between the objects 2 and/or the number of objects 2 to be processed together in such a group 1 have to be matched to this ability to bend.

A comparison of FIG. 2*a* (straight line of holding elements) with FIG. 2*b*, showing the holding means 3 arranged on a stretch of rail 6 with a circular bend and, therefore, the held edges 10 being aligned in a circular arc, demonstrates how the alignment of the object zones opposite the held edges 10 is not only dependent on the distances between the objects, but also on the manner in which the held edges 10 are aligned, i.e. on the shape of the stretch of rail 6.

In order to produce a real stack from a stack-like arrangement as illustrated in FIGS. 2*a* and 2*b*, the objects 2 are released by the grippers 5 and therewith the zones of the held edges 10 can be brought into a juxtaposed position, and, if so required, the object zones opposite the held edges 10 can be fully aligned with one another. This alignment represents a sliding relative movement between the objects 2 to be stacked and for this reason is advantageously limited to a minimum by a best possible alignment of these zones already in the stack-like arrangement.

Figure 3B:
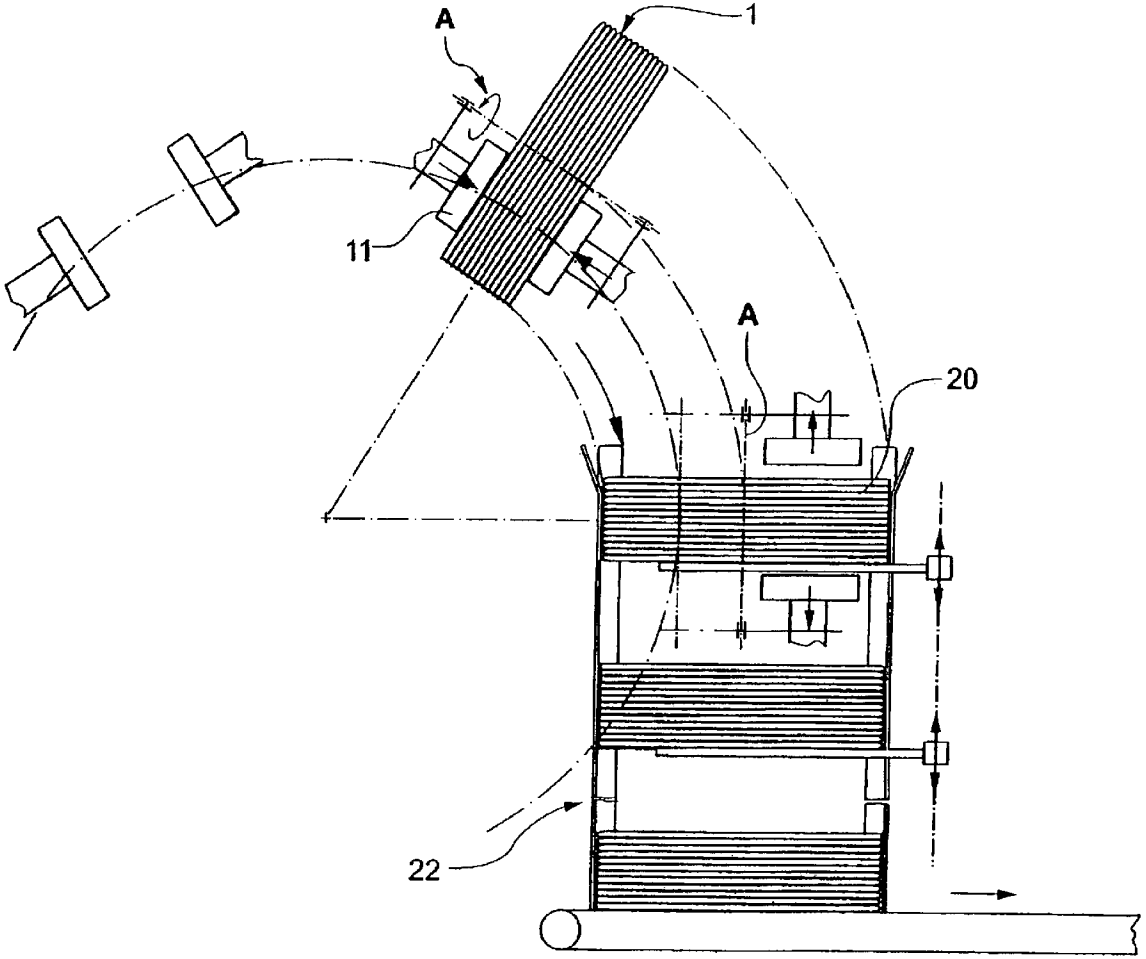

FIGS. 3*a* and 3*b* schematically illustrate the course of the method according to the invention on the basis of an embodiment of the method, in which simple stacks (orientation of all objects in the stack is the same) or cross stacks (orientation of the objects in alternating stack sections is rotated by 180° around the stacking axis A) can be produced.

FIG. 3*a* illustrates the production of simple stacks 20 or of stacks, respectively, in which the correlation between the orientation of the objects is the same in the supply stream and in the stack. The holding elements 3 are driven in conveying direction F along a stretch of rail 6 (represented by a dot-dash line) in groups 1, in which they are closely adjacent to one another (minimum distances between the objects).

The object zones opposite the held edges 10 of the group 1 are grasped, brought together, and pressed together by pressing means 11, which in this phase are moved along a track 21 parallel to the stretch of rail. Advantageously, the holding elements 3 in this phase are arranged on a circularly bent section of the stretch of rail 6 (also refer to FIG. 2*b*). By the pressing effect, the stack-like arrangement is stabilized and the objects 2 can be released by the holding elements.

For this purpose, the stretch of rail 6 and the track 21 on which the pressing means 11 move diverge and control means (not shown) open the grippers 5. The group 1 stabilized by the pressing means 11 is transported by the pressing means towards a stacking shaft 22 and is deposited in the stacking shaft. Thereupon, the pressing means 11 are moved apart for releasing the group 1 and are moved out of the stacking shaft 22, for example, laterally.

The stacks 20 produced in the described manner are removed from the bottom of the stacking shaft in an as-such known manner or they are combined in the stacking shaft into a stack comprising several stack sections, which stack is only then released from the stacking shaft 22. In the latter case, a plurality of stacking tables 23 being movable out of the stacking shaft sideways has to be provided.

If cross stacks are to be produced with the method illustrated in FIG. 3*a*, the stacking shaft is to be equipped for receiving a stack section, while a lower stack section is rotated by 180° around the stacking axis and for then adding the deposited stack section to the rotated stack.

The stack-like arrangement, in which the object zones opposite the held edges 10 are held lying adjacent to one another by pressing means 11 may also be directly submitted to a strapping operation in which a strapping tape 24 is laid around the group 1 of objects 2 arranged in the stack-like manner. This is shown by the detail designated with the reference number 25. Such strapping can be carried out in an as-such known strapping station arranged where holding elements 3 and pressing means 11 travel in parallel. Following the release of the objects 2 by the holding elements 3, a stack-like arrangement stabilized with pressing means 11 may, for example, be directly deposited on a conveying-away belt without requiring a stacking shaft 22.

For the method variant as illustrated in detail 25 it is necessary that the object zones opposite the held edges 10 are aligned with one another in the stack-like arrangement in a manner that is also satisfactory for the definitive stack.

The method according to FIG. 3*b* differs from the method according to FIG. 3*a* in that every second group of objects 1 is rotated around the stacking axis A by 180° when the objects 2 are released from the holding elements (not illustrated) and before deposition of the group in the stacking shaft 22. This rotation is realized with a corresponding rotation of the pressing means holding the group 1. As a result, stacks 20 deposited in the stacking shaft 22 become crossed layers, i.e., stack sections rotated relative to one another around the stacking axis A by 180°, and a plurality of such stack sections form a cross stack.

A device for carrying out the methods in accordance with FIGS. 3*a* and 3*b* comprises, for example, a conveying system according to the publication WO-99/33731, as well as a circulation system equipped for the necessary movements of a plurality of pressing means 11, a stacking shaft 22 and means for conveying-away stacks 20 produced in the stacking shaft 22. For the variant 25 a strapping station is provided instead of the stacking shaft 22.

Figure 4:
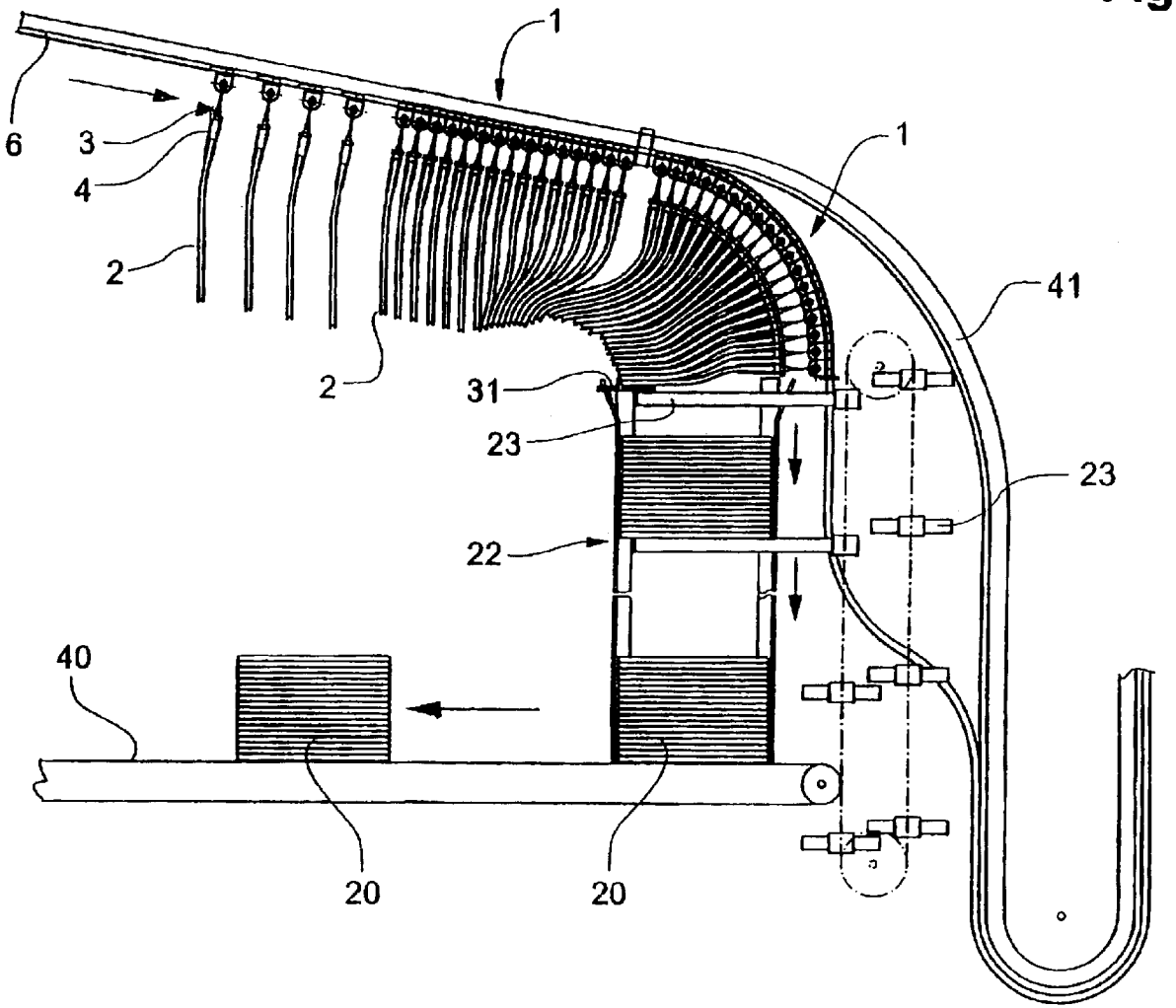
FIG. 4 shows an exemplary embodiment of the device according to the invention for producing simple stacks.

FIG. 4 illustrates in a very schematic manner an exemplary embodiment of the device in accordance with the invention, which device serves for producing simple stacks 20 from objects 2 supplied either in groups or individually. The device comprises a conveying system with holding elements 3, a stretch of rail 6, and a suitable drive for moving the holding elements 3 along the stretch of rail 6, e.g., in the manner as already described further above. The conveying system is designed such that groups 1 of supplied objects 2 are guided above the stacking shaft 22 and are arranged stack-like with the help of a correspondingly routed rail section (e.g. in a circular arc) and of a stacking table 23, wherein the stacking table 23 serves as stabilizing means, if so required, supported by an auxiliary support 31. The objects 2 in the stack-like arrangement are released by the grippers 4, for example, by opening the grippers 4 and swivelling them away (or by opening the grippers 4 and pushing away the objects with a corresponding cam member). Therein release takes place, either for one object after the other while the stacking table 23 is lowered into the stacking shaft continuously and when each object becomes guided by the stacking shaft walls, or else for all objects of one stack or one stack section at the same time and only when the complete stack 20 (or stack section) is positioned within the stacking shaft. Prior to lowering the stacking table 23, the auxiliary support 31 needs to be swivelled out of the opening of the stacking shaft.

Advantageously, the stacking shaft 22 comprises a plurality of stacking tables 23, which are circulating such that, during formation of a stack-like arrangement and its positioning in the stacking shaft 22, a previously established stack 20 can be lowered onto a conveying-away means 40 (e.g., a conveying-away conveyor belt) for being transported away. If the groups 1 represent only partial stacks, then the stacking tables 23 have to be designed for being swivelled or drawn out of the stacking shaft. For producing cross stacks while using a similar device, the lower part of the stacking shaft 22 has to be designed for rotatation around the stacking axis.

In the region of the stacking shaft, the stretch of rail 6 runs downwards, so that the force of gravity can be exploited as a driving force for the holding elements 3. Therefore, no further drive is needed in this region and a drive, to which the holding means 3 are coupled and as is described e.g. in the publication WO-99/33731, may run on a conveying track 41 different from the conveying track of the holding elements (stretch of rail 6). As a result, it becomes possible to give the circular arc shaped section of the stretch of rails a smaller radius.

Figure 5A:
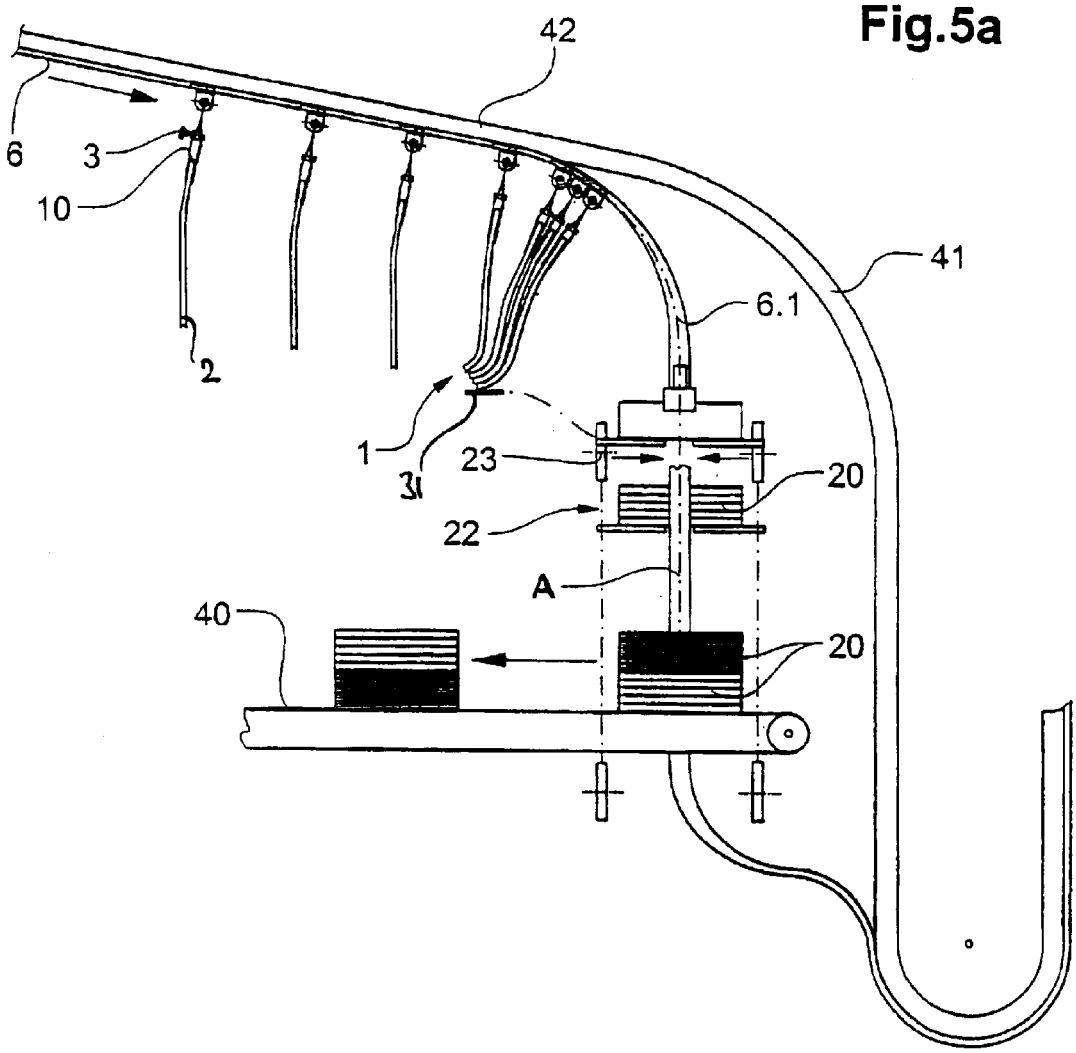
FIGS. 5*a* and 5*b* are a side view (FIG. 5*a*) and a view from above (FIG. 5*b*) of a further exemplary embodiment of the device in accordance with the invention for producing cross stacks.
Figure 5B:
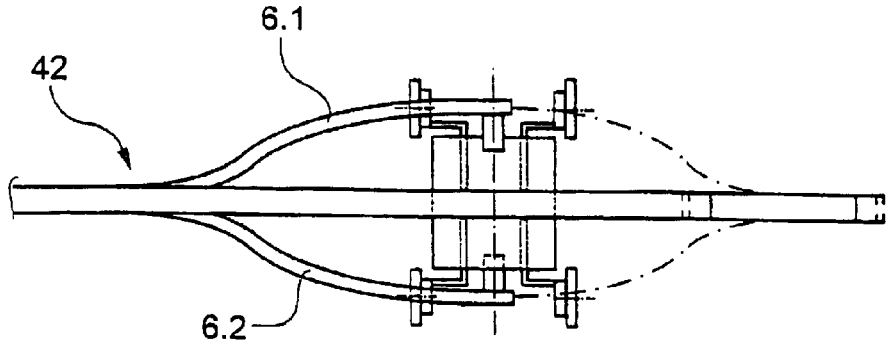

FIGS. 5*a* and 5*b* show in a side view (FIG. 5*a*) and viewed from above (FIG. 5*b*) a further, exemplary embodiment of the device according to the invention. This embodiment comprises as the embodiment of FIG. 4*a* conveying system with holding elements 3 and a stretch of rail 6, as well as a stacking shaft 22 and a conveying-away means 40 for stacks.

In contrast to the embodiment of FIG. 4, the stretch of rail 6 comprises a controlled branching-off point 42 above the stacking shaft 22, from where two branches 6.1 and 6.2 (both visible in FIG. 5*b*) extend downwards on either side of the stacking shaft 22 while being twisted by 90° in opposite directions. Groups 1 of objects 2 are alternatingly steered onto one or the other rail stretch 6.1 or 6.2 and, as a result, are rotated by 90° in alternating directions before being deposited on the stacking table 23 from opposite sides to form stack-like arrangements being stabilised by the stacking table 23 and the auxiliary support 31, and to form, after release, a cross stack in the stacking shaft 22. The auxiliary support 31 is advantageously designed and arranged for supporting object zones opposite the held edges 10 during the rotation by 90°, during which rotation group 1 is formed and brought into the stack-like arrangement.

The holding elements 3 are driven along the rail stretches 6.1 and 6.2 by the force of gravity so that, above the stacking shaft 22, a following-on drive in accordance with WO-99/33731 may run along a conveying track 41, which is different from the conveying tracks of the holding elements 3 (stretches of rail 6.1 and 6.2). This results in a very simple device, which comprises substantially no movable parts serving the alternating rotation of the stack sections.

Figure 6A:
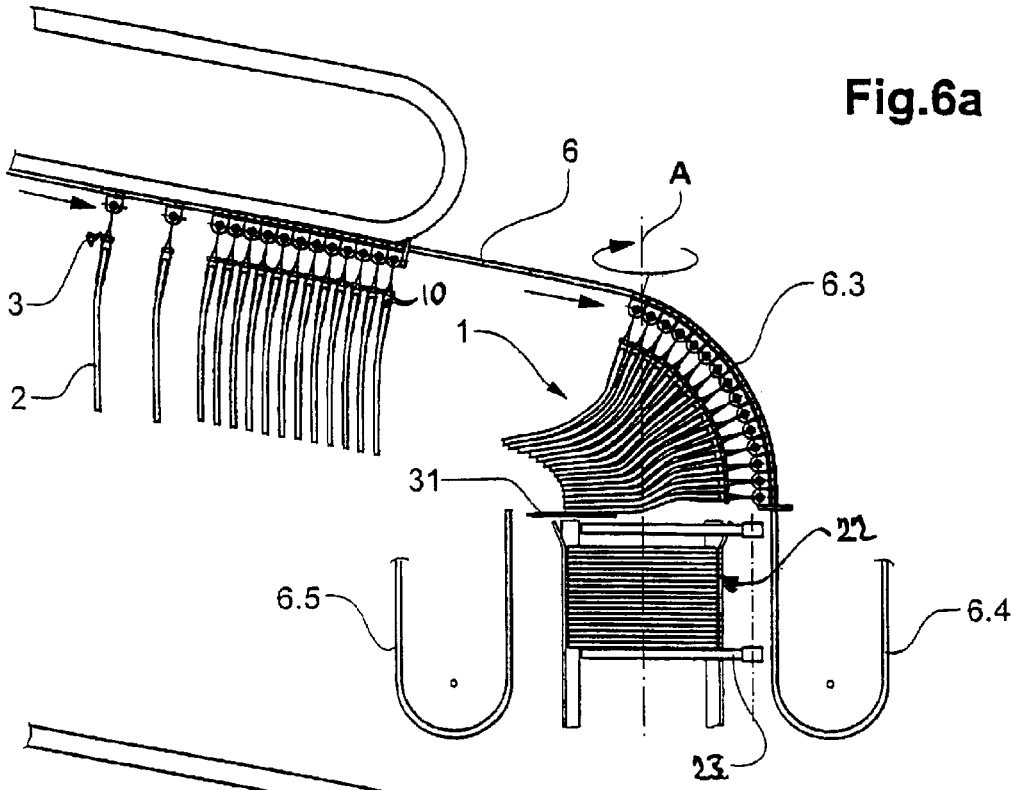
FIGS. 6*a* and 6*b* show a further exemplary embodiment of the device according to the invention for producing cross stacks, in two successive phases, in which two successive stack sections rotated relative to one another by 180° are produced.
Figure 6B:
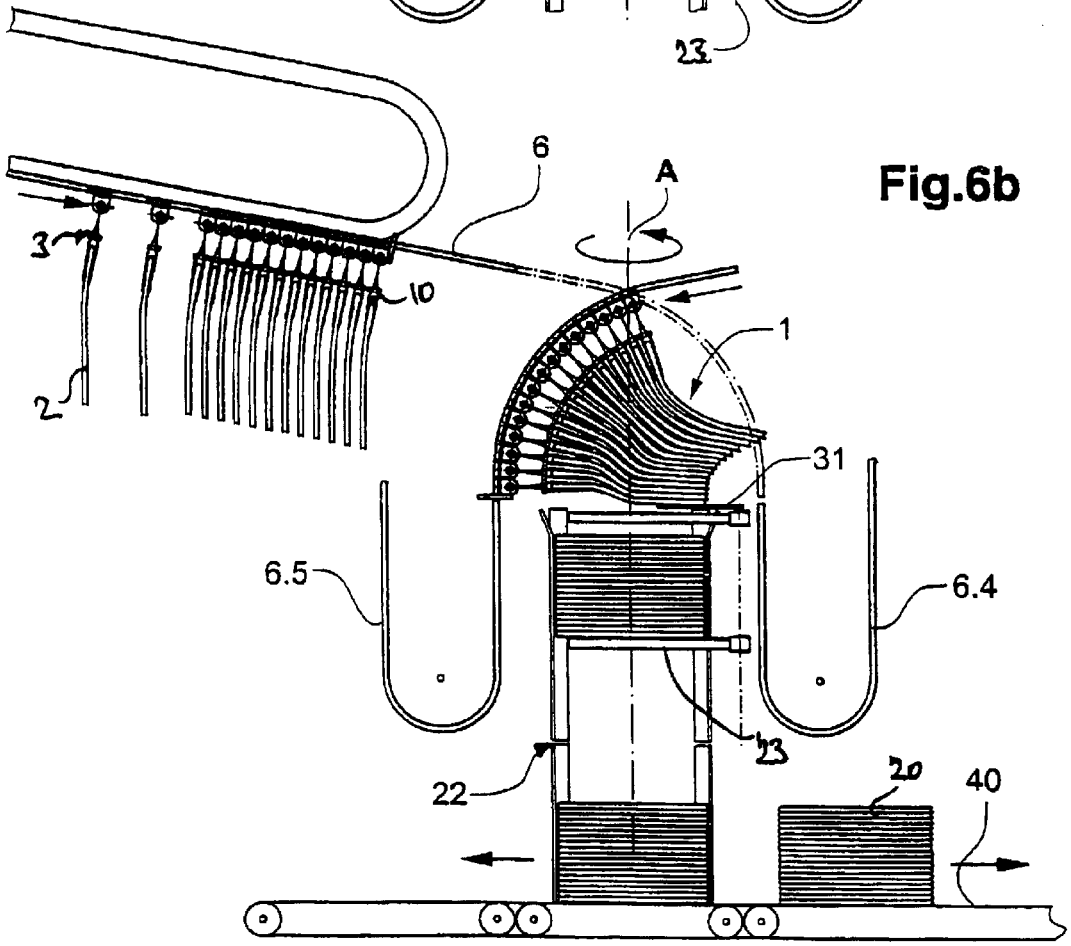

FIGS. 6*a* and 6*b* illustrate a further, exemplary embodiment of the device in accordance with the invention, again designed for producing cross stacks. FIG. 6*a* depicts the device in a configuration for depositing a first stack section and FIG. 6*b* depicts the device in a configuration for depositing a second stack section following the first stack section and, relative to the first stack section, being rotated by 180° around the stacking axis A. The device once again comprises a conveying system with holding elements 3 and a stretch of rail 6, as well as a stacking shaft 22 with a plurality of stacking tables 23 capable of being lowered in the stacking shaft, and a conveying-away means 40.

The stretch of rail 6 comprises above the stacking shaft 22 a rail section 6.3 capable of being rotated by 180° around the stacking axis A and comprising a circular arc shaped zone and two rail sections 6.4 and 6.5 capable of being connected to section 6.3 in either one of its rotation positions and serving for conveying away the holding elements 3 after release of the objects 2. In one of its rotation positions (FIG. 6*a*) the rotatable rail section 6.3 connects with the supply rail 6, along which the holding elements 3 with the objects are supplied. Objects 2 or holding elements 3, respectively, being conveyed onto the rotatable rail section 6.3 form a group 1 and are arranged stack-like (stabilised by the auxiliary support 31). Every second group 1 arranged stack-like is rotated together with the rotatable rail section 6.3 and the auxiliary support 31 by 180° around the stacking axis A, so that the rail section connects with the other one of the conveying-away rail sections 6.5. This position is illustrated in FIG. 6*b*.

From the two positions illustrated in the FIGS. 6*a* and 6*b*, the objects 2 of the groups 1 arranged in a stack-like manner are released from being held and are lowered into the stacking shaft 22. The empty holding elements are conveyed away. Following the phase illustrated in FIG. 6*b*, the rotatable rail section 6.3 and the auxiliary support 31 are rotated back and the next stack-like arrangement is formed (according to FIG. 6*a*) and for releasing this one, the rotatable rail section 6.3 is not rotated.

It is also conceivable, that the rotatable rail section 6.3 assumes a middle position for being connected to the supply rails 6 and is rotated by 90° in opposite directions for depositing alternating stack sections.

What is claimed is:

1. A method for producing stacks of flat objects (2), wherein each object (2) has a first edge region and an opposing second edge region, said method comprising the steps of:

conveying the objects (2) serially in a supply stream, wherein, in the supply stream, the objects (2) are held individually in the first edge regions, are oriented substantially transverse to the conveying direction (F) and essentially parallel to one another, and are aligned with one another, forming groups (1) of the objects (2) while the objects are being conveyed in the supply stream, each group comprising a plurality of successive objects (2) arranged in a stack-like manner and each group being formed by bringing the second edge regions of the plurality of the objects (2) into a position in which they are in contact with each other and essentially aligned with each other and stabilizing the second edge regions in said position, and releasing the first edge regions of the objects from being held, thereby forming the stacks.

2. The method according to claim 1, wherein, in each group (1) of objects arranged in the stack-like manner, the first edge regions are aligned with one another in a circular arc.

3. The method according to claim 1, wherein each group (1) of objects arranged in the stack-like manner is stabilized by pressing the second end regions against one another.

4. The method according to claim 1, wherein each group (1) of objects arranged in the stack-like manner is stabilized by positioning, in a stack-like manner, the second end regions on a support (23, 31).

5. The method according to claim 1, wherein the groups (1) of objects arranged in the stack-like manner are strapped prior to the objects (2) of the groups being released from being held.

6. The method according to claim 1, wherein the groups of objects arranged in the stack-like manner are deposited on a stacking table (23) of a stacking shaft (22) and are at least partially lowered into the stacking shaft (22) before the objects (2) of the groups are released from being held.

7. The method according to claim 1, wherein the groups (1) constitute stack sections (20) which are formed into stacks comprising several stack sections.

8. The method according to claim 7, wherein, for producing cross stacks, successive stack sections (20) or successive groups (1) of objects arranged in a stack-like manner, respectively, are alternatingly rotated around the stacking axis (A) by 90° in opposite directions or by 0° and 180°.

9. A device for forming stacks of flat objects (2), said objects (2) each having a first edge zone and an opposing second edge zone, the device comprising:

a conveying system for conveying the objects in a supply stream, wherein the conveying system comprises a plurality of holding elements (3) and a stretch of rail (6), wherein the holding elements (3) are equipped for holding a flat object (2) in the first edge zone (10) and are displaceable along the stretch of rail (6) such that objects (2) transported one behind the other are capable of being transported such that the objects (2) are substantially parallel to one another and aligned with one another, and means for forming groups of the objects (2) while the objects (2) are being conveyed in the supply stream, wherein each group comprises a plurality of the objects (2) arranged in a stack-like manner, said group forming means including means for bringing the second edge zones of a plurality of successive objects (2) into a position in which they are in contact with each other and means for stabilizing the second edge zones in said position, stacking means for forming the stacks from the groups, said stacking means including a control means for releasing the objects (2) arranged in a stack-like manner in each group (1) from the holding elements, and a conveying-away means for conveying away the stacks being produced.

10. The device in accordance with claim 9, wherein the means for forming the groups comprises a rail section shaped like a circular arc.

11. The device according to claim 9, wherein the means for forming the groups comprises a pressing means (11).

12. The device according to claim 11, wherein a plurality of pressing means (11) are provided, said pressing means being movable on a circular track.

13. The device according to claim 12, wherein at least one of said plurality of pressing means (1) is designed for rotating a group (1) held by said at least one pressing means (11) around the stacking axis (A).

14. The device according to claim 9, wherein the stacking means further comprises a stacking shaft (22) and wherein the stretch of rail (6. 6.1, 6.2, 6.3, 6.4, 6.5) extends from above toward the stacking shaft (22) downwards beside the stacking shaft (22) and wherein the control means for releasing the objects (2) is arranged at a level of the upper end of the stacking shaft (22).

15. The device according to claim 14, wherein the means for forming the groups comprises a support, said support comprising a stacking table (23) vertically movable within the stacking shaft (22) or an auxiliary support (31).

16. The device according to claim 14, wherein the stretch of rail (6, 6.1, 6.2) above the stacking shaft (22) comprises a controllable branching-off point (42) and from the branching-off point (42) runs downwards on two opposite sides of the stacking shaft (22), wherein rail sections (6.1, 6.2) between the branching-off point (42) and the stacking shaft (22) are each respectively twisted by 90° in opposite directions.

17. The device according to claim 14, wherein the stretch of rail (6, 6.3, 6.4, 6.5) comprises a rail section (6.3) and conveying-away rail sections (6.4, 6.5), said rail section extending above the stacking shaft and being rotatable around the stacking axis (A), said conveying-away rail sections (6.4, 6.5) being disposed on two opposite sides of the stacking shaft (22), to which the rail section (6.3) is capable of being selectively connected.

* * * * *